US008262871B1

(12) United States Patent
Mayer et al.

(10) Patent No.: US 8,262,871 B1
(45) Date of Patent: Sep. 11, 2012

(54) PLATING METHOD AND APPARATUS WITH MULTIPLE INTERNALLY IRRIGATED CHAMBERS

(75) Inventors: Steven T. Mayer, Lake Oswego, OR (US); Shantinath Ghongadi, Wilsonville, OR (US); Kousik Ganesan, Tualatin, OR (US); Zhian He, Tigard, OR (US); Jingbin Feng, Lake Oswego, OR (US)

(73) Assignee: Novellus Systems, Inc., San Jose, CA (US)

( * ) Notice: Subject to any disclaimer, the term of this patent is extended or adjusted under 35 U.S.C. 154(b) by 309 days.

(21) Appl. No.: 12/640,992

(22) Filed: Dec. 17, 2009

Related U.S. Application Data

(60) Provisional application No. 61/139,178, filed on Dec. 19, 2008.

(51) Int. Cl.
*C25B 9/00* (2006.01)
*C25D 17/00* (2006.01)

(52) U.S. Cl. ..... 204/263; 204/242; 205/80

(58) Field of Classification Search ..... 204/263, 204/242
See application file for complete search history.

(56) References Cited

U.S. PATENT DOCUMENTS

| | | | | |
|---|---|---|---|---|
| 3,450,625 | A | 6/1969 | Ramsey et al. | |
| 3,652,422 | A | 3/1972 | Powers et al. | |
| 3,706,651 | A | 12/1972 | Leland | |
| 3,862,891 | A | 1/1975 | Smith | |
| 4,033,833 | A | 7/1977 | Bestel et al. | |
| 4,035,278 | A * | 7/1977 | Wilkinson et al. | 204/222 |
| 4,073,708 | A | 2/1978 | Hicks, Jr. | |
| 4,082,638 | A | 4/1978 | Jumer | |
| 4,240,886 | A | 12/1980 | Hodges et al. | |
| 4,272,335 | A | 6/1981 | Combs | |
| 4,304,641 | A | 12/1981 | Grandia et al. | |
| 4,469,564 | A | 9/1984 | Okinaka et al. | |
| 4,545,877 | A | 10/1985 | Hillis | |
| 4,604,177 | A | 8/1986 | Sivilotti | |
| 4,604,178 | A | 8/1986 | Flegener et al. | |
| 4,605,482 | A | 8/1986 | Shirgami et al. | |
| 4,696,729 | A | 9/1987 | Santini | |
| 4,828,654 | A | 5/1989 | Reed | |
| 4,906,346 | A | 3/1990 | Hadersbeck et al. | |

(Continued)

FOREIGN PATENT DOCUMENTS

EP 0037325 3/1981

(Continued)

OTHER PUBLICATIONS

U.S. Appl. No. 12/337,147, filed Dec. 17, 2008.

(Continued)

*Primary Examiner* — Harry D Wilkins, III
*Assistant Examiner* — Zulmariam Mendez
(74) *Attorney, Agent, or Firm* — Weaver Austin Villeneuve & Sampson LLP

(57) ABSTRACT

An apparatus for electroplating a layer of metal onto a work piece surface includes a membrane separating the chamber of the apparatus into a catholyte chamber and an anolyte chamber. In the catholyte chamber is a catholyte manifold region that includes a catholyte manifold and at least one flow distribution tube. The catholyte manifold and at least one flow distribution tube serve to mix and direct catholyte flow in the catholyte chamber. The provided configuration effectively reduces failure and improves the operational ranges of the apparatus.

21 Claims, 10 Drawing Sheets

U.S. PATENT DOCUMENTS

| | | | |
|---|---|---|---|
| 4,931,149 | A | 6/1990 | Stierman et al. |
| 4,933,061 | A | 6/1990 | Kulkarni et al. |
| 5,039,381 | A | 8/1991 | Mullarkey |
| 5,096,550 | A | 3/1992 | Mayer et al. |
| 5,146,136 | A | 9/1992 | Oruga et al. |
| 5,156,730 | A | 10/1992 | Bhatt et al. |
| 5,162,079 | A | 11/1992 | Brown |
| 5,217,586 | A | 6/1993 | Datta et al. |
| 5,316,642 | A | 5/1994 | Young, Jr. et al. |
| 5,368,711 | A | 11/1994 | Poris |
| 5,391,285 | A | 2/1995 | Lytle et al. |
| 5,421,987 | A | 6/1995 | Tzanavaras et al. |
| 5,443,707 | A | 8/1995 | Mori |
| 5,472,592 | A | 12/1995 | Lowery |
| 5,476,578 | A | 12/1995 | Forand |
| 5,498,325 | A | 3/1996 | Nishimura et al. |
| 5,516,412 | A | 5/1996 | Andricacos et al. |
| 5,567,300 | A | 10/1996 | Datta et al. |
| 5,935,402 | A | 8/1999 | Fanti |
| 6,027,631 | A | 2/2000 | Broadbent |
| 6,126,798 | A | 10/2000 | Reid et al. |
| 6,132,587 | A | 10/2000 | Jorne |
| 6,193,860 | B1 | 2/2001 | Weling |
| 6,251,255 | B1 | 6/2001 | Copping et al. |
| 6,368,475 | B1 | 4/2002 | Hanson et al. |
| 6,391,166 | B1 | 5/2002 | Wang |
| 6,391,188 | B1 | 5/2002 | Goosey |
| 6,395,152 | B1 | 5/2002 | Wang |
| 6,402,923 | B1 | 6/2002 | Mayer et al. |
| 6,497,801 | B1 | 12/2002 | Woodruff et al. |
| 6,527,920 | B1 | 3/2003 | Mayer et al. |
| 6,755,954 | B2 | 6/2004 | Mayer |
| 6,773,571 | B1 | 8/2004 | Mayer et al. |
| 6,821,407 | B1 | 11/2004 | Reid et al. |
| 6,890,416 | B1 | 5/2005 | Mayer et al. |
| 6,964,792 | B1 | 11/2005 | Mayer et al. |
| 7,622,024 | B1 | 11/2009 | Mayer et al. |
| 2003/0029527 | A1 | 2/2003 | Yajima et al. |
| 2003/0102210 | A1 | 6/2003 | Woodruff |
| 2010/0032303 | A1 | 2/2010 | Reid et al. |
| 2010/0032310 | A1 | 2/2010 | Reid et al. |
| 2010/0116672 | A1 | 5/2010 | Mayer et al. |

FOREIGN PATENT DOCUMENTS

| | | |
|---|---|---|
| JP | 59-162298 | 9/1984 |
| JP | 09-53197 | 2/1997 |
| JP | 2001316887 | 11/2001 |
| WO | WO /9941434 | 8/1999 |

OTHER PUBLICATIONS

U.S. Appl. No. 09/872,340 entitled "Methods and Apparatus for Bubble Removal in Water Wet Processing" filed May 31, 2001.

U.S. Office Action for U.S. Appl. No. 09/706,272 mailed May 22, 2002.

U.S. Notice of Allowance for U.S. Appl. No. 09/706,272 mailed Oct. 29, 2002.

U.S. Office Action for U.S. Appl. No. 10/318,497 mailed Sep. 28, 2004.

U.S. Notice of Allowance for U.S. Appl. No. 10/318,497 mailed Jan. 6, 2005.

U.S. Office Action for U.S. Appl. No. 10/231,147 mailed Jun. 10, 2004.

U.S. Notice of Allowance for U.S. Appl. No. 10/231,147 mailed Sep. 7, 2004.

Fang, et al., "Uniform Copper Electroplating on Resistive Substrates," Abs. 167, 205$^{th}$ Meeting, © 2004 The Electrochemical Society, Inc., 1 page.

* cited by examiner

▼ Means and Std Deviations

| Level | Mean | Std Dev | Std Err Mean | Lower 95% | Upper 95% |
|---|---|---|---|---|---|
| A | 17.3514 | 5.82245 | 0.95720 | 15.410 | 19.293 |
| B | 9.3750 | 3.79254 | 0.94813 | 7.354 | 11.396 |

A system without flow distribution tubes in the catholyte chamber
B system with flow distribution tubes in the catholyte chamber to irrigate the membrane Oneway Analysis of Defect By Configuration Means and Std Deviations

| Level | Mean | Std Dev | Lower 95% | Upper 95% |
|---|---|---|---|---|
| A | 190.600 | 129.904 | 97.672 | 283.53 |
| B | 15.643 | 3.954 | 13.360 | 17.93 |
| C | 17.351 | 5.822 | 15.410 | 19.29 |
| D | 9.226 | 4.717 | 7.496 | 10.96 |

A: Poor irrigation, low $O_2$ level
B: Good irrigation, low $O_2$ level
C: Poor irrigation, high $O_2$ level
D: Good irrigation, high $O_2$ level

PLATING METHOD AND APPARATUS WITH MULTIPLE INTERNALLY IRRIGATED CHAMBERS

CROSS-REFERENCE TO RELATED APPLICATIONS

This application claims benefit under 35 U.S.C. §119(e) to U.S. Provisional Application No. 61/139,178, filed Dec. 19, 2008, which is incorporated by reference herein.

FIELD OF THE INVENTION

This invention relates to electroplating apparatus designs. More specifically, this invention relates to an electroplating apparatus design for depositing electrically conductive materials on a semiconductor wafer for integrated circuit manufacturing.

BACKGROUND

Manufacturing of semiconductor devices commonly requires deposition of electrically conductive materials on semiconductor wafers. The conductive material, such as copper, is often deposited by electroplating onto a seed layer of metal deposited onto the wafer surface by a physical vapor deposition (PVD) or chemical vapor deposition (CVD) method. Electroplating is a method of choice for depositing metal into the vias and trenches of the wafer during damascene and dual damascene processing. To meet the demands of modern semiconductor processing, the electrically conductive material deposited on the surface of a semiconductor wafer needs to have the lowest possible defect density.

Damascene processing is a method for forming interconnections on integrated circuits (ICs). It is especially suitable for manufacturing integrated circuits, which employ copper as a conductive material. Damascene processing involves formation of inlaid metal lines in trenches and vias formed in a dielectric layer (inter-metal dielectric). In a typical damascene process, a pattern of trenches and vias is etched in the dielectric layer of a semiconductor wafer substrate. Typically, a thin layer of an adherent metal diffusion-barrier film such as tantalum, tantalum nitride, or a TaN/Ta bilayer is then deposited onto the wafer surface by a PVD method, followed by deposition of electroplate-able metal seed layer (e.g., copper, nickel, cobalt, ruthenium, etc.) on top of the diffusion-barrier layer. The trenches and vias are then electrofilled with copper, and the surface of the wafer is planarized.

SUMMARY

An electroplating apparatus for electroplating a layer of metal onto a work piece surface is provided. The electroplating apparatus includes a chamber and a membrane separating the chamber into an anolyte chamber and a catholyte chamber. In various embodiments, the electroplating apparatus further includes a catholyte manifold region associated with the catholyte chamber. The catholyte manifold region includes a ring-shaped catholyte manifold and at least one flow distribution tube associated with the catholyte manifold. In some embodiments, the catholyte manifold is located immediately above the membrane. In further embodiments, the catholyte manifold includes holes configured to deliver a flow of an electrolyte. Flow of electrolyte from the holes in the catholyte manifold may be turbulent, in some embodiments.

In some embodiments, a flow distribution tube is located at least about one tube diameter from the membrane. In further embodiments, a flow distribution tube is located between about two to four tube diameters from the membrane.

In another embodiment, the electroplating apparatus further includes a diffuser plate at the top of the catholyte chamber. In some embodiments, a flow distribution tube is located at least about one tube diameter from the diffuser plate, and in further embodiments, a flow distribution tube is located between about two to five tube diameters from the diffuser plate.

In various embodiments, a flow distribution tube may have many different configurations. The flow distribution tube may be configured to deliver a flow of electrolyte towards the membrane. The flow distribution tube may be a porous tube or a tube with at least one hole along the circumference of the tube. A hole in the flow distribution tube may be configured to deliver a turbulent flow of an electrolyte. A hole in the flow distribution tube may be oriented in the direction of the membrane. The tube may also have two or more holes along the circumference of the tube, the holes having different diameters. The flow distribution tube includes two ends, and both ends may be attached to the catholyte manifold or one end may be attached to the catholyte manifold. In some embodiments, the plane containing the flow distribution tube is substantially parallel to the plane of the membrane.

In further embodiments, an anolyte manifold region is associated with the anolyte chamber. The anolyte manifold region includes an anolyte manifold and at least one flow distribution tube associated with the anolyte manifold.

In another embodiment, a method of electroplating a layer of metal onto a work piece surface is provided. The work piece is held in a work piece holder of an electroplating apparatus. The electroplating apparatus includes a membrane separating an electroplating chamber into an anolyte chamber and a catholyte chamber. The catholyte chamber includes a catholyte manifold and at least one flow distribution tube associated with the catholyte manifold. The catholyte manifold and the at least one flow distribution tube are configured to increase convection of an electrolyte at the membrane. In certain embodiments, oxygen is removed from the electrolyte, and a current is supplied to the work piece to plate the metal layer onto the work piece surface.

These and other aspects and advantages are described further below and with reference to the drawings.

DETAILED DESCRIPTION OF THE INVENTION

Figure 1:
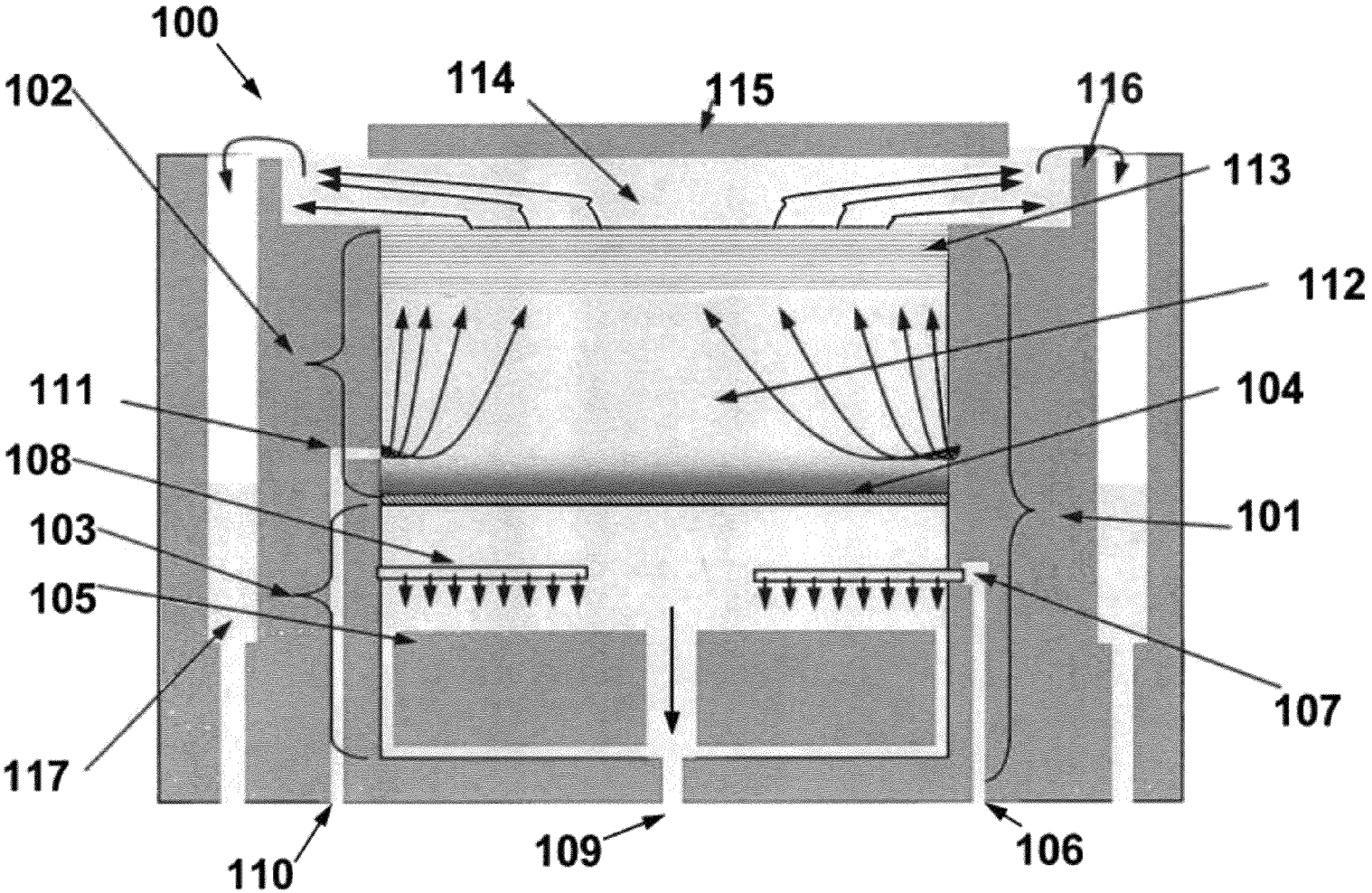
FIG. 1 depicts an example of a dual chamber (separated anode) electroplating cell layout and components along with what might be the typical flow pattern within the apparatus.

Reference will now be made in detail to specific embodiments. Examples of the specific embodiments are illustrated in the accompanying drawings. While the invention will be described in conjunction with these specific embodiments, it will be understood that it is not intended to limit the invention to such specific embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known process operations have not been described in detail in order not to unnecessarily obscure the present invention.

Introduction

An overview of embodiments of the invention is set forth below.

An electroplating cell design is described, containing 1) an anolyte chamber (sometime referred to herein as a "separated anode chamber") having at least one anode and a 2) catholyte chamber, in communication with the anolyte chamber, typically containing a High Resistance Virtual Anode "HRVA" plate (alternatively, a flow diffuser plate). The anolyte and catholyte chambers are connected to, and in electrical (cationic) communication with each other though a cationic membrane. The design and particular pattern of flow in the catholyte chamber was believed, until now, to be relatively unimportant. This belief was at least in part due to the fact that the membrane is not an active anode with an electrochemically generated species thereupon. Therefore, the careful creation and/or control of a strong internal mixing pattern within the catholyte chamber were previously deemed to be unimportant. Furthermore, imparting convective flow at the catholyte side of the membrane was not considered to lead to any beneficial results. In embodiments, the catholyte chamber has a mechanism for mixing and directing catholyte flow in the catholyte chamber, particularly around and upon the cationic membrane surface, to improve the general material transport to and away from the membrane surface.

It has been determined that by enabling sufficiently strong catholyte mixing within the catholyte chamber region, particularly by enabling flow to be convected to and from the region near the cationic membrane surface, a significant reduction in failure of the electroplating cell is achieved. Also, an improved operational range (such as, but not limited to, higher current, higher salt concentrations, lower temperature, and lower catholyte/wafer impinging flow velocities passing through the HRVA) of the tool is achieved. While not wanting to be held to any particular theory, it is believed that this result is at least in part due to the inhibition of deleterious effects in the cationic membrane caused by (1) a precipitation of metal ion salts crystals (e.g., copper sulfate) causing a membrane blockage/shutdown/passivation phenomena, (2) precipitation, electrodeposition, or electroless deposition of other organic and metallic films on the membrane, or (3) other deleterious processes associated with a locally high concentration of reactive species near the membrane surface and more generally in the catholyte chamber. Each of the above processes potentially creates a tendency to form a plume of particles from the membrane, resulting in particles that may circulate within the catholyte chamber, which can subsequently lead to defects on the plated part (i.e., the wafer).

Embodiments presented herein are described in terms of an electroplating tool and chamber, but it is understood by those skilled in the art that the embodiments could be extended to electroetching, electropolishing, and electrochemical mechanical polishing tools, in which the poles of the electrodes are reversed. Therefore, in this context, any references to anode, anolyte, catholyte, the direction of current flow, etc., are generic to the plating configuration, and are not meant to be otherwise limiting. The disclosure is presented in this manner for clarity and to avoid undo repetition. Aspects of the invention relate to an electroplating, electroetching, electropolishing, or electrochemical mechanical polishing tool, the tool containing a counter electrode (typically anode, when used for plating) chamber. The tool is typically divided into two or more subsections, designated an anolyte and catholyte chamber.

For example, various "clamshell" electroplating apparatus designs (e.g., the Sabre™ apparatus available from Novellus Systems of San Jose Calif.) have two chambers, an anolyte chamber and a catholyte chamber. The anolyte and the catholyte chambers are separated from each other by a cationic membrane. The anolyte chamber contains one or more counter electrodes as well as one or more energized electrodes that have the same general polarity as the wafer and an electrolyte is in direct contact with the electrodes. In some embodiments, these energized electrodes may be an auxiliary secondary cathode, such as described in U.S. patent application Ser. No. 12/481,503, filed Jul. 9, 2009, and entitled METHOD AND APPARATUS FOR ELECTROPLATING, which is incorporated by reference in it entirety.

The catholyte chamber, not containing a counter electrode, typically has a uniquely different electrolyte composition, a separate mechanism of internally circulating electrolyte (catholyte), and a separate supply of electrolyte than the anolyte chamber, the electrolyte contained therein capable of making direct contact with the work piece (e.g., a wafer). A design for substantially directing flow and/or the passage of electrical current uniformly to the work piece, such as by a micro-porous diffuser (typically greater than about 20% porous; see U.S. Pat. No. 6,964,792, issued Nov. 15, 2005 and incorporated herein by reference) or a HRVA plate (see U.S. Pat. No. 7,622,024, issued Nov. 24, 2009 and incorporated herein by reference), may be used. The HRVA plate is typically less porous than a more simple flow diffuser (a HRVA plate is typically less than about 5% porous) and imparts a significantly larger electrical resistance to the system (adding resistance improves uniformity/control), but, like the diffuser, creates a uniform flow of electrolyte at the wafer.

In certain described embodiments, the catholyte chamber contains peripheral walls, a HRVA plate (or diffuser) that faces and is in close proximity (typically less than about 5 mm) to the substrate (wafer) being plated, and a mechanism of directing electrolyte into the chamber. The main flow loop electrolyte enters the catholyte chamber, passes up through the HRVA plate (or diffuser) through various pores or holes, and then impinges on a wafer surface. After being directed generally towards and passing near the wafer surface, the fluid passes out of the plating cell and eventually back to the main bath tank.

The anolyte chamber contains peripheral walls and has a separate flow of (typically) substantially organic-additive-free plating solution (i.e., electrolyte, or anolyte) which circulates in a manner separate from the uniquely different "main plating solution flow loop" electrolyte (i.e., catholyte) that makes contact with the wafer surface.

FIG. 1 depicts an example of a dual chamber (separated anode) electroplating cell layout and components along with what might be the typical flow pattern within an apparatus containing some (but not all) of the elements in accordance with various embodiments. Note that this and later figures are offered as examples for illustration purposes, and should not be construed to be limiting to the general applicability of embodiments to any particular cell, for example, or with respect to any particular spatial orientation, required elements, dimensions, or design components. Electroplating cell 100 includes a chamber 101 that includes a catholyte chamber 102 and an anolyte chamber 103. At one extremity of the anolyte chamber resides a membrane 104 (e.g., a cationic membrane), completely enclosing the anode 105 to create the anolyte chamber 103. The membrane may be supported by a membrane frame (not shown). The anode may be either an active (dissolvable) metal or metal alloy (e.g., copper, copper/phosphorous, lead, silver/tin) to be plated or an inert (dimensionally stable, e.g., platinum coated titanium) anode. The anode is connected to one pole of a power supply (not shown). The two separate chambers, with two separate electrolyte flow loops, generally have electrolytes of different compositions, with different electrolyte properties (e.g., typically, the electrolyte in the anolyte chamber is substantially free of electrochemical organic bath additives).

A flow of electrolyte is fed into the anolyte chamber at location 106 and then into a manifold 107 where it enters one or more flow distribution tubes (also referred to as irrigation "flutes" or nozzles) 108. Note that in FIG. 1, for clarity, the anolyte chamber electrolyte flow loop is only shown on the right hand side of the drawing. The flow distribution tubes "spray" electrolyte in the general direction of the anode 105 surface so as to impinge on the anode surface, thereby increasing the convection of dissolved ions from the anode surface or electrolyte reactant to the surface (if required). In an example of another embodiment that is not illustrated, the anode is porous, composed of an assembly or pile of relatively small individual active metal piece (e.g., individual spheres). The porous metal pile allows easy anode replenishment as well as the direct passage of electrolyte fluid upwards or downwards through the "porous anode pile". This type of apparatus typically consists of an inlet anolyte flow manifold residing at the bottom of the anode chamber, that further contains a mechanism for directing flow upward though a porous anode electrical-terminal-plate (or anode buss plate), which is designed to allow uniform flow of electrolyte and supply of current into and though the assembly of individual anode pieces. See U.S. Pat. Nos. 6,527,920, 6,890,416, and 6,821,407, incorporated herein by reference for all purposes, as further examples of separated anode chamber designs. The flow exits the anode chamber of FIG. 1, at location 109. The anolyte chamber is bounded by peripheral insulating walls made of a non-conducting material (e.g., various plastics like polypropylene).

The flow of electrolyte directed to the anode surface reduces the concentration polarization (i.e., the voltage increase associated with the build up of or depletion of dissolved active species, constituting a diffusion resistances and polarization) and mitigates any tendency for the anode surface to become passivated. Anode passivation is a phenomena where a metal salt, oxide, phosphate sulfide, or other form of a surface film forms, for example, as a result of surpassing the local solubility limit of the material. Anode passivation catastrophically increases the resistance for current flow, greatly inhibiting the ability to pass further current. Anode passivation can also cause the uniformity of the deposited film to greatly diminish. Use of the flow distribution tubes or similar mechanism avoids anode passivation. An electroplating tool having both an anolyte chamber with a separate flowing electrolyte and the use of flow distribution tubes in the anolyte chamber also mitigates wafer defects and by preventing particles and films on the anode from being formed and/or transported to the wafer surface. This enables the use of high sustained currents, relatively high deposition rates, and associated higher wafer throughput, coupled with low defectivity. These electroplating tool features also decrease the rate of plating bath degradation, improving cost of ownership (CoO).

As noted above, the anolyte chamber and the catholyte chamber are separated by an ionically permeable, electrolyte and additive diffusion- and flow-resistant membrane (typically, a cationic membrane). Cations traverse the membrane, from the anolyte chamber to the catholyte chamber, under the influence of the electric field, on their way towards the substrate (wafer) being plated. The membrane substantially prevents the diffusion or convection of other non-positively charged electrolyte components from passing out of or into the anolyte chamber, such as anions and uncharged organic plating additives. In some instances, the anolyte chamber and its recirculation flow loop (if any) are substantially free of plating additives, while the catholyte chamber may contain target levels of plating bath additives (e.g., accelerators, suppressors, levelers, and the like) required to support the operation of the plating process on the substrate (for example, low concentration of chloride ions, plating bath organic compounds such as thiourea, benzotrazole, mercaptopropane sulphonic acid (MPS), dimercaptopropane sulphonic acid (SPS), polyethylene oxide, polyproplyene oxide, and their various copolymers, etc.).

Media that are micro-porous and resist direct fluid transport can serve as membranes. The membrane may be a cationic conducting membrane, such as commercially available material by the trade name Nafion, from Dupont Corporation of Wilmington Del. In some cases, the membrane is supported by a mechanically supporting frame member (not shown) at its uppermost and/or bottommost surface, which helps to fix and confine the membrane in a particular shape (e.g., conical) and remain relatively rigid despite electrolyte flow or small differential pressures between the two sides of the membrane and between the two chambers.

While the membrane is an electrically dielectric (i.e. an electron-conduction-resistive material) and there is no free flow of electron charge transfer at the surface of, or within, the membrane, ionically charged species exit the membrane in a somewhat analogous fashion to an anode source, and the concentration profiles near the interfaces are believe to be qualitatively similar. While not being held to any particular theory, it is believed that the membrane acts in some respects similar to a conventional source of ions (such as an active metallic anode electrode interface undergoing an electrochemical oxidation process). The membrane may also have some important subtle differences, discussed in more detail herein.

Charged species, when they pass though any porous barrier under the impetus of an electric field, do so largely at a rate proportional to their concentrations and ionic mobility μ. Diffusion is largely limited (at least initially on start up) because of the absence of any significant concentration driving force, as well as because of the tortuous nature of the membrane barrier. Smaller ions that tend to have high ionic mobilities (e.g., protons) tend to migrate more rapidly. In an electrolyte containing two or more cations, the ion with the higher mobility will tend to favorably pass out of the anolyte chamber. As a result, the concentration of the ion with the lower ionic mobility (for example a larger metal ion) will tend to accumulate in the anolyte chamber. Eventually (in the case of an active metal anode configuration) the concentration of the lower mobility metal ion created at the anode can increase substantially, often approaching the solubility limit of that ion in the anode chamber. In any case, the concentration difference between the ions with the different mobilities between the two sides of the membrane increases with the passage of charge and time. If left unaltered, the concentration difference may eventually become sufficiently large enough between the two chambers so that the electric field induced flux of each ionic species (given by the product of the ion concentration times its mobility) will closely balance the time average diffusion of that species in the opposite direction.

For example, in the case of a chamber containing a copper anode and a mixed electrolyte such as copper sulfate and sulfuric acid, smaller hydrated hydrogen ion protons will migrate out of and across the membrane preferentially, tending to increase the catholyte chamber's pH. In contrast, the concentration of copper will increase within the anolyte chamber. Furthermore, a cationic membrane allows very little anion (sulfate and bisulfate, in this example) to pass. Within a cationic membrane, the mobile charged cationic species is typically paired to an anion end group (e.g., a polymer bound anionic sulphonate group) tethered to the ends of a polymeric backbone (e.g., a perfluorinated backbone in the case of Dupont's commercially available "Nation" cationic membrane). The cation moves under the force of the electric field from the environment of one fixed/tethered anion to the next (thereby maintaining charge neutrality within the membrane). The electrochemistry and the concentration profiles of various species in an electroplating cell are discussed in more detail herein.

Turning back to FIG. 1, similar to the mode by which electrolyte enters the anolyte chamber, electrolyte enters the catholyte chamber at location 110 and enters a manifold 111 that surrounds the catholyte chamber, from where it is introduced into the central regions of catholyte chamber 112 below the HRVA plate 113. Note that in FIG. 1, for clarity, the catholyte chamber electrolyte flow loop is only shown on the left hand side of the drawing. As shown in FIG. 1, flow entering from the periphery tends to travel in currents of decreasing velocity at locations more central to catholyte chamber, largely because the summation of the cross sectional area for the flow out through the HRVA is greatest, and the integral resistance to flow smallest, at the HRVA periphery. The result is uniform flow up through the HRVA and into the wafer/HRVA gap region 114 below wafer 115. Unlike the anolyte chamber that contains a mechanism for directing flow at the anode, the catholyte chamber in FIG. 1 does not contain a mechanism for directing catholyte fluid entering the catholyte chamber at location 111 at membrane 104 which separates the catholyte chamber/anode chamber. Therefore, the intensity of mixing within the catholyte chamber in this electroplating apparatus is small, the electrolyte flow within the catholyte chamber tends to be laminar, and the flow lines within the catholyte chamber are concentrated at the periphery of the chamber and tend to be in a direction away from membrane 104. Very little flow tends to pass near the membrane surface, creating little replenishment, removal of, or mixing of materials there. After passing out through the HRVA the fluid eventually makes it way to over a plating cell weir wall 116 and into a collection chamber 117, from where it is collected and returned to the catholyte circulation bath storage tank. The catholyte chamber also has non-conducting peripheral walls.

Due to the ever increasing need to establish more uniform fluid and plating current flow to a thinner seeded wafer, a High Resistance Virtual Anode "plate" (HRVA) may be employed to beneficially introduce a significant terminal effect compensating resistance to the system. One example of a HRVA containing apparatus is described in U.S. patent application Ser. No. 12/291,356 titled METHOD AND APPARATUS FOR ELECTROPLATING, filed Nov. 7, 2008, which is incorporated herein by reference in relevant part. See also U.S. patent application Ser. No. 11/506,054 titled METHOD AND APPARATUS FOR ELECTROPLATING INCLUDING A REMOTELY POSITIONED SECOND CATHODE, filed Aug. 16, 2006, which is incorporated herein by reference in relevant part. The wafer is brought into close proximity to (e.g., 1-5 mm from) the HRVA plate surface during plating operations. The HRVA plate introduces a resistance to both electrical conduction and fluid flow, making both more uniformly distributed across the plate and across the wafer near its surface.

However, to ensure uniform flow upwards through the HRVA plate, the portion of the catholyte chamber below the HRVA plate, which acts as a fluid dispensing manifold region, needs to have a substantial depth and cross sectional flow area to allow the resistance to be dominated by the HRVA pores or holes. Therefore, if special additional measures are not otherwise taken, the flow pattern within the catholyte chamber will tend to be slow, laminar, and quite quiescent. Note that a similar condition can arise in systems employing a more porous diffuser "plate" (See U.S. Pat. No. 6,964,792 issued Nov. 15, 2005, which is incorporated herein by reference). As a general rule, the lower the HRVA/diffuser flow resistance, the larger the necessary size of the catholyte chamber, so as to appropriately enable the HRVA/diffuser to dominate the resistance to flow and create a uniform pattern. Note that even a HRVA plate with about 2-5% porosity typically does not present a very large total electrolyte fluid flow resistance (pressure drop), because the total cross sectional area to available flow is often still quite large (e.g., a 300 mm diameter, 5% porous HRVA plate has a total open cross sectional area for flow of about 35 $cm^2$, equivalent to a single pipe/tube with a diameter of about 2.6 inches).

In this sense, a HRVA plate is similar to a diffuser plate, but has a greater resistance to both fluid and current flow. Both the HRVA and the diffuser are typically relatively thin plates (about 0.125 to 1 inches thick). A HRVA plate typically has a very low, uniform, continuous, and in some embodiments, unidirectional porosity. Unidirectional porosity is created, for example, by creating a large number or small precision holes in a non-porous substrate, typically about 1-5% of the plate's material; see U.S. patent application Ser. No. 11/506,054 (filed Aug. 16, 2006), U.S. patent application Ser. No. 12/291,356 (filed Nov. 7, 2008), and U.S. Pat. No. 7,622,024, each incorporated herein by reference. The HRVA holes are created by drilling, etching, creating a replicate structure, or other appropriate processes, resulting in an insulating surface having a very large number of high precision parallel fine holes (typically 0.02 to 0.04 inch diameter) in a substrate/ plate. The unidirectional holes/pores generally prevent any fluid or electrical current from passing in any direction that is not directly towards the work piece (e.g., traveling/leakage from just below the plate at an radial angle though the plate towards the wafer periphery). This promotes a uniform flow distribution and potential distribution.

Note that in some instances, components in the electroplating cell shown in FIG. 1 are referred to by different names. Sometimes, chambers 102 and 103 are collectively referred to as an anode chamber. Chamber 102 is then an upper anode chamber and chamber 103 is a lower anode chamber. In this case, chamber 103 is referred to as a separated anolyte chamber (SAC), wherein the SAC contains the anode and is separated from the upper anode chamber by membrane 104. The region and the fluid between membrane 104 and the lower surface of the HRVA plate 113 (i.e., region 112), plus that within HRVA plate itself, constitute the catholyte chamber. Also, the catholyte chamber is sometimes referred to as the Diffuser or HRVA chamber. The HRVA plate 113 mounts onto the anode chamber (102 and 103), creating region 114 between the wafer and the top of the HRVA plate, which in this case is referred to as the wafer-to-HRVA gap region (alternatively diffuser-to-wafer gap region).

Figure 2:
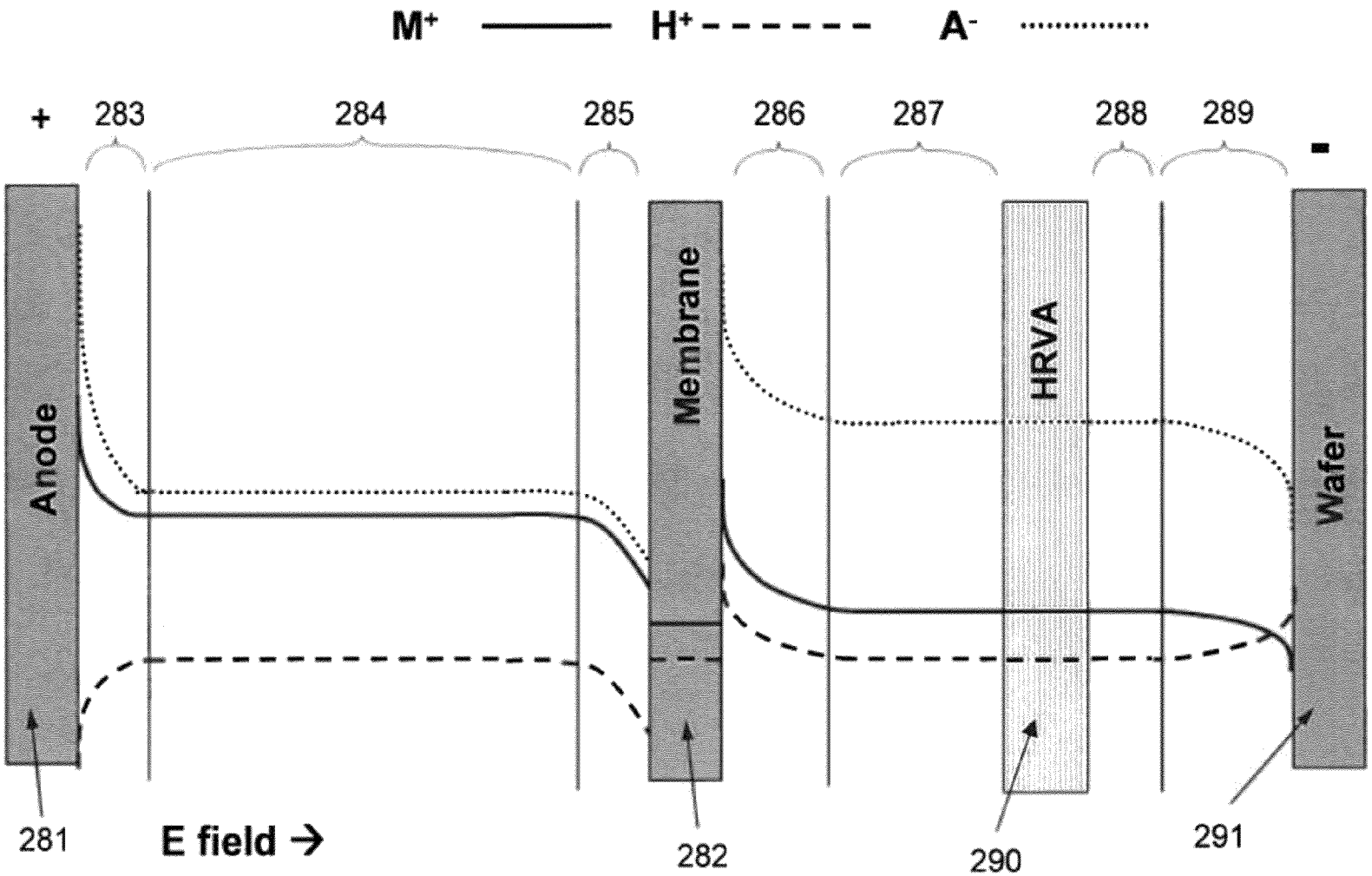
FIG. 2 is a schematic illustration that exemplifies what is believed to be a typical situation in a dual chamber reactor containing several important dissolved components in the electrolyte in a separated-anode-chamber electroplating cell.

FIG. 2 is a schematic illustration that exemplifies what is believed to be a typical situation in a dual chamber reactor containing several important dissolved components in the electrolyte in a separated-anode-chamber electroplating cell. Anode 281 is shown as a source of metal ions (i.e., an "active anode", with metal ions shown generically as $M^+$, though the charge can be divalent or multivalent). In some situation an inert anode is used. The solution may also contain an acid (shown as a proton $H^+$) or a base (not shown), as is known in the art, typically added to a plating solution to serve as a "supporting electrolyte component", reducing the system resistance. The counter anion is depicted as $A^-$. The membrane 282, which in this figure is a cationic membrane, a HRVA or diffuser plate 290, and the work piece 291 (labeled "wafer") are also depicted. With the application of a potential difference by external mechanisms (source and complete circuit not shown), the anode assumes a positive potential and positive charge with respect the work piece, and the work piece assumes a relative negative potential and negative charge. A voltage gradient and electric field are established, which if sufficiently large results in the desired level of current between the two surfaces (i.e., the anode and the wafer). The anolyte chamber resides in areas 283, 284, and 285, the catholyte chamber resides in areas 286, 287, and the wafer-to-HRVA gap region resides in areas 288 and 289.

Regions where there are significant changes in concentrations reside near interfaces and are physically small, typically microscopic, on the order of a few to a few hundreds of microns (i.e., for 283, 285, 286, and 289, with the size scale depending on the amount of convection near the interfaces and the associated boundary layer thicknesses). The other regions are more macroscopic, depending on the exact cell layout, but typically in the range of from about a few centimeters to about 20 cm. In regions 284, 287, and 288, the passage of current is due to the migration of species, balanced by the requirement that no net space charge is developed, resulting in a flat concentration profile. Though the diffuser/HRVA is a porous media and may be viewed as a membrane, there is no significant gradient of concentrations across the diffuser/HRVA, at least in part because of the imposed flow and transport of fluid from the catholyte chamber, though the element and outwards.

At the anode interface region 283 where metal ions are created, the surface concentration of metal-ions is higher than in the bulk solution in the anolyte chamber, region 284. The actual anode metal-ion surface-concentration is proportional to the flux (current), which is proportional to the cation/anion pair's effective diffusion coefficient, $D_{eff}$, [$D_{eff}=(z^+u^+D^+-z^-u^-D^-)/(z^+u^+-z^-u^-)$, where + and − superscripts refer to the cation and anion, respectively, z is the charge of the ion, u is the mobility of the ion, and D is the diffusion coefficient of the ion] and inversely proportional to the mass transfer anode boundary layer thickness. For a given boundary layer thickness, further increases in current at some point will lead to a surface concentration that surpasses the solubility limit for the metal ion in the solution, and metal salt precipitation and anode passivation can result. Higher convection leads to a thinner boundary layer thickness, and for a given current, a lower metal surface ion concentration. This is why it is beneficial to have a mechanism to force convection at the anode interface (i.e., items such as flow distribution tubes, 108).

Since in this example it is assumed that neither acid nor anion are created at the anode, the proton concentration is low at the anode interface 283 (rejected and transported away from the interface by the migration in the electric field, but this force is balanced in steady state the backwards diffusion towards the interface by the concentration gradient). Likewise, the anion is attracted to the interface 283 by migration forces, but is not consumed at the anode, so its concentration is balanced in the steady state by diffusion away from the interface. Therefore, the anion has a concentration which is high at the interface and the proton concentration lower than the bulk. Using a similar line or reasoning, it is clear why the metal ion and anion concentration at the work piece interface are lower than the bulk, and the proton concentration tends to be higher.

Now turning to region 285 (anode chamber side of the membrane), the cationic membrane, by its design and function, prevents the transport of anions through it. The direction of the electric field in the cell tends to force the anions away from the interface, and the surface concentration at the interface is lower than the bulk in the anolyte chamber. To maintain charge neutrality and match the concentration of anions in this region, the total concentration of cations will decrease here. Also, both metal ions and protons can pass through the membrane, and any gradient of concentration of the cations also drives diffusion to the membrane interface. The net result is a general reduction in total ionic strength in the region, not leading to a potentially deleterious supersaturation condition. Within the membrane, the transport of metal ions and protons is almost entirely by migration, and their concentration is limited by the concentration of available anion pair bound to the membrane's polymeric backbone.

In region 286 (wafer side of the membrane), unlike the region around an anode surface, both metal ions and protons flow from the interface (only metal ions have a net flux from a metal anode surface), because both must be transported though and exit the wafer side of this region. Hence, the surface concentration of both species (acids and metals) at the membrane interface tends to be higher than that in the interior of the catholyte chamber. Anions are drawn to the surface by the electric field but can not pass though the cationic membrane. The solubility of the metal salt and the acid are typically linked through their solubility products through the common anion pair, and hence, this situation can potentially lead to a precipitation of metal salt at the membrane surface.

In addition to creating a high concentration of dissolved metal ions, counter-ions, and supporting electrolyte ions at the interface of the membrane, any other negatively charged species residing in the catholyte chamber will also tend to accumulate at the membrane interface. This is particularly the case for a cationic membrane, through which negatively charged species are not permitted to pass. While not wanting to be held to any particular theory, it is believed that certain negatively charged organic reduction species are sometimes created by electro-reduction at the work piece during the plating process. For example, consider the formation of a plating bath reducing intermediate from the plating accelerator and strong cuprous and cupric ion complexing mercapto propane sulphonate, potentially formed at a copper interface at sufficiently negative surface potentials:

$$MPS^{-}+e^{-}MPS^{-2} \quad (1)$$

The concentrations and behavior of these reduced species should depend on the specific plating bath organic additives' composition, concentrations, current density, duty cycle, accumulated charge passed, and bath replenishment rates, among other parameters. Whatever the particular mechanism, it is further suggested that some of the organo-reduced species which were originally neutral acquire a charge (an electron) from the cathode/work piece interface and become negatively charged anions, after which they may desorbed from the interface, and pass into the electrolyte and any recirculating plating bath. It is further supposed that the reduced organic anions may be unstable with respect to a reaction with the metal ions in the electrolyte, and can undergo a non-faradic (e.g., an electroless or chemical) charge transfer reaction with the metal ion, transferring their acquired electron to the metal cation and reducing the metal ion to its metallic form. Using the mercapto propane sulphonate reduced species as an example, one possible reaction would be:

$$2MPS^{-2}+Cu^{+2}\rightarrow 2MPS^{-}+Cu. \quad (2)$$

This reaction may occur either homogeneously or heterogeneously (at an interface) or both, though it is theoretically believed to occur with a greater propensity heterogeneously because of the well know reduction in 3-D phase formation nucleation energy of heterogeneous solution precipitated materials. Once some seed metal particles of surface film are formed, the nucleation energy barrier is no longer present and the rate of reaction (2) will generally increase. These negatively charged species may be at very low concentrations in the electrolyte as a whole, but due to the electric field within the plating chamber, such ions will tend to be separated from the electrolyte, migrating and accumulating at the cationic membrane. As noted above, this is also a region which is believed to have the highest concentration of metal ions, so the above reaction should occur there at the highest rate. Therefore, it is suggested that such an electroless redox reaction will tend to occur at a much greater rate at and in the vicinity of the cationic membrane interface than elsewhere in the system because of tendency for the redox negatively formed organic plating additive to accumulate there. The above mechanism explains how metal can be deposited/reduced in the solution as well as onto the reactor surface, including various non-conductive surfaces, and furthermore explains the general tendency of the deposition to occur at the membrane surface. Whatever the exact mechanism, it has been confirmed, by characterization of a membrane, that reduced metal films do form on the wafer side of the cationic membranes, as well as in the vicinity of membrane supporting frame members. Normally, metal residing in the electrolyte and so formed as suggested above would be expected to be simultaneously oxidized (etched) by the spontaneous reaction with dissolved oxygen or other dissolved oxidizer, $$2M+O_2+4H^{+}\rightarrow 2M^{+2}+2H_2O. \quad (3)$$

However, while again not wanting to be held to any particular theory, the above reaction rate will depend on the supply of oxygen to the location where the metal is formed. Oxygen exists at relatively low concentrations in the electrolyte (about 8 ppm in water at 20° C.), and being an uncharged species, should not accumulate at or migrate to the membrane interface. Therefore, without sufficient agitation of the electrolyte, the above reaction (3), which tends to remove metal from the membrane, may be exceeded by the rate of formation of the metal, as from reaction (2). Is has been found that metal accumulation is greatest in regions believed to have the least agitation, such as around the outer periphery of the membrane, near the ribs of the membrane frame, and particularly under the membrane frame. Also, for example, under certain extraneous conditions (including but not limited to low bath temperatures, long duration high currents, certain combinations of plating bath additives and their concentrations, and over long period of use in a demanding production environment) particulate and film formation and buildup on the catholyte chamber exposed cationic membrane surface may occur. For example, in extreme cases, crystals (e.g., copper sulfate pentahydrate) may form over a cationic membrane. Furthermore, over longer periods of operation where crystal formation may be avoided, a metallic film may form on the cationic membrane. These metallic/particulate/crystal films, as a group, cause a number of potential operational problems, including but not limited to passivating the membrane (blocking ionic flow, leading to a non-uniformity excursion), a rapid change in and out of control defectivity, or simply a persistent but undesirable source of plated film defects.

Furthermore, the formation of these films on the membrane appears to cause permanent damage to the cationic membrane. This is evident by examination of membranes after removing the crystal film (by salt dissolution with water) and the metallic film (e.g., by etching with a dilute peroxide/acid solution). Such membranes appear micro-fractured, possibly due to the precipitation of the salt or metal film inside the microscopic (nano-scale) pores of the cationic membrane. Potentially, such fracturing could cause the membrane to have fissures and cracks all the way across the element, allowing fluid to pass directly between the two chambers, defeating the membrane's purpose.

It is important to note that while nominal amounts of dissolved oxygen may allow metal precipitate formation reactions such as (3) and avoid the formation of precipitated metal in the cell, bath, and particularly on the membrane, there are other competing reasons why creating a degassed electrolyte (one substantially free of both oxygen and other dissolve gasses) may be desirable. Electrolyte degassing can be achieved, for example, by passing the solution though a commercially available shell-and-tube contactor, with a partial vacuum drawn on the shell side of the contactor. This separates out the dissolved gas from the liquid and lowers its partial pressure. By degassing the solution, bubbles within the electrolyte and at the electrolyte/air surface will dissolve and dissipate quickly in a degassed fluid. This introduces an efficient means of bubble removal, particularly for very small bubbles, as one does not have to rely on bubbles rising and breaking the surface to be removed from the system. The reasons one might want to remove bubbles from the solution are many, but one reason is that when a wafer enters into the bath to be plated, bubbles at the fluid surface can be trapped to or under the wafer surface and block the surface from being plated there. Hence, by degassing the electrolyte, the number of small bubbles that cause a specific type of plating defect (un-plated spherical regions, referred to as plating "pit" defects) has been shown to be greatly reduced. Also, removal of oxygen reduces the rate of corrosion of the wafer surface metal (seed layer) by the same reaction as in (3), and can lead to better feature filling performance on marginal quality PVD metalized layers, particularly within high aspect ratio damascene structures. As mentioned above, dissolved oxygen (a higher level of oxygen) is potentially useful in avoiding another type of defect (metal precipitation in the solution or formation on the cell membrane, cup, etc.), as by reaction (3), and so a means of driving reaction (3) or the like in a solution with a low concentration of dissolved gas, including oxygen, is desirable.

By including apparatus to create an impinging flow directed at the membrane interface according to various embodiments, no metal formation at the membrane or frame or at any other location in the catholyte chamber is observed. The precipitation of metal on the membrane and frame area can be avoided even in a degassed solution, with an oxygen concentration of less than about 0.5 ppm, with sufficiently intense convection. This is presumably due to the increased rate of reaction (3), facilitated by the greater convection and supply of oxygen to the interfaces, and the lower surface concentration of metal ion and reduced organic additive of reactions such as reaction (2), facilitated by the convection of these species away from the membrane.

DESCRIPTION OF APPARATUS/METHOD

In various embodiments, the catholyte chamber is defined by a membrane (in some embodiments, a cationic membrane) with a design feature for directing catholyte flow to impinge substantially at the membrane surface so as to increase convection at the membrane interface. In previous catholyte chamber designs, flow in the catholyte chamber has been laminar and quiescent at the membrane interface. With embodiments of the disclosed design and method, the catholyte is well-mixed at the membrane interface and, in some embodiments, elsewhere throughout the chamber. In some embodiments, at least some of the catholyte is delivered to the chamber in the turbulent flow regime. Furthermore, the catholyte adjacent to the membrane may be agitated or even turbulent. This increases the mixing and results in the enhanced transport of various materials contained within the catholyte, including but not limited to the solvent, cations (e.g., metal ions such as copper, nickel, cobalt, tin, lead, silver, etc.), anions (e.g., sulfate, phosphate, chloride, bromide, iodide), organic bath additives (neutral or charged), materials present or added as oxidizers (e.g., oxygen, ozone, persulfate, peroxide), and dissolved gasses (e.g., oxygen, ozone, nitrogen, carbon dioxide). The flowing of catholyte onto the membrane surface also aids in suspending, flushing, and removing objects that might otherwise accumulate at the surface, potentially blocking the membrane from passing current or creating a source of defects in the plated substrate (e.g., gas bubbles, metallic particles, insoluble salts, etc.). Embodiments described herein have been shown to decrease the propensity for salt to precipitate at the membrane surface (e.g., by elimination of conditions that might otherwise lead to a super-saturation at the interface), allowing for a wider range of plating operating conditions such as higher currents, higher salt concentrations, lower temperatures, or lower catholyte/wafer impinging flow velocities passing through the HRVA. Embodiments have also been shown to result in a substantial reduction in defects observed on an electroplated wafer.

Figure 3A:
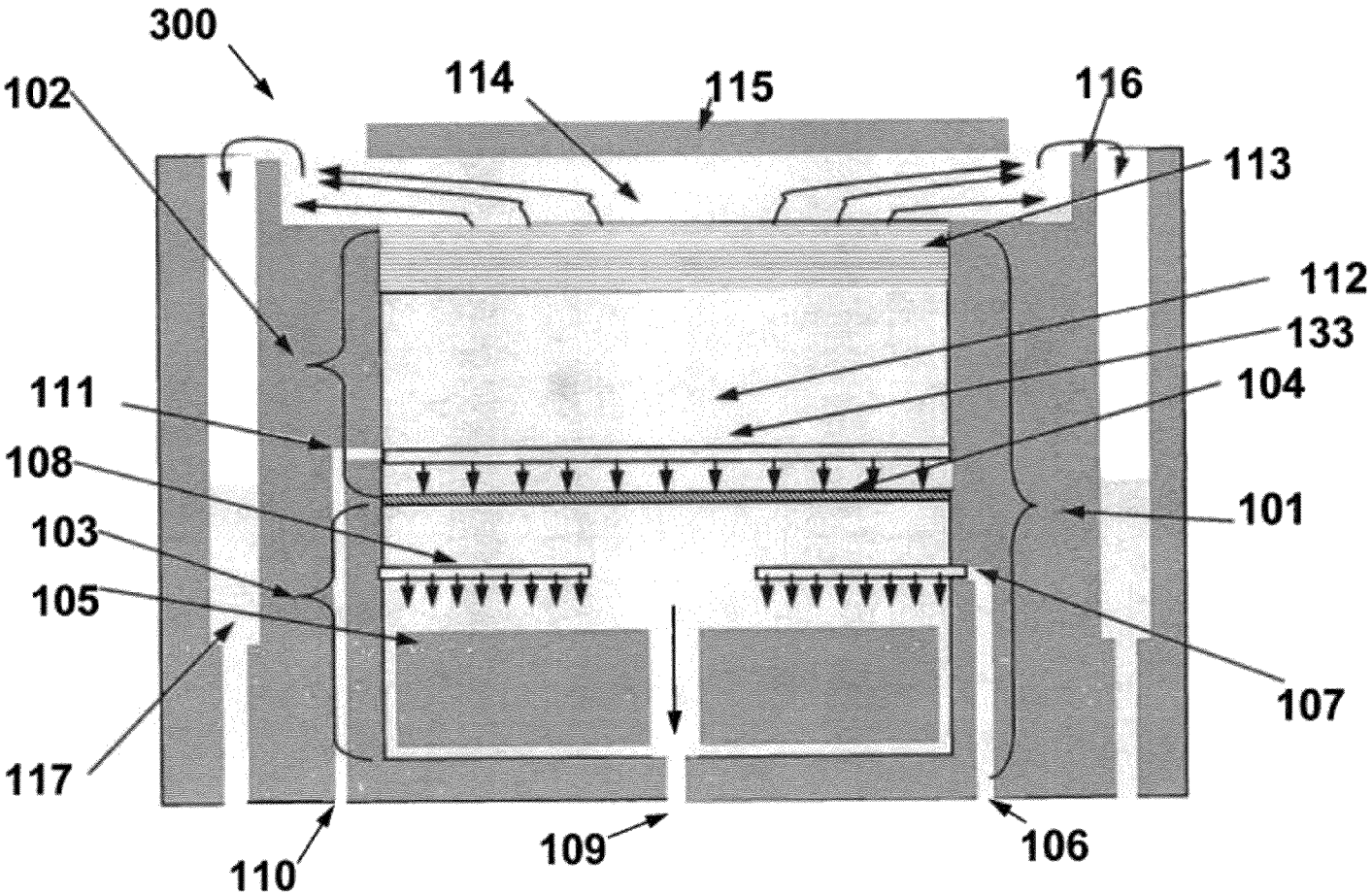
FIGS. 3A-B depict an example of an electroplating cell layout with flow distribution tubes (note that only the isometric image of FIG. 3B shows two tubes) associated with a catholyte manifold according to an embodiment.
Figure 3B:
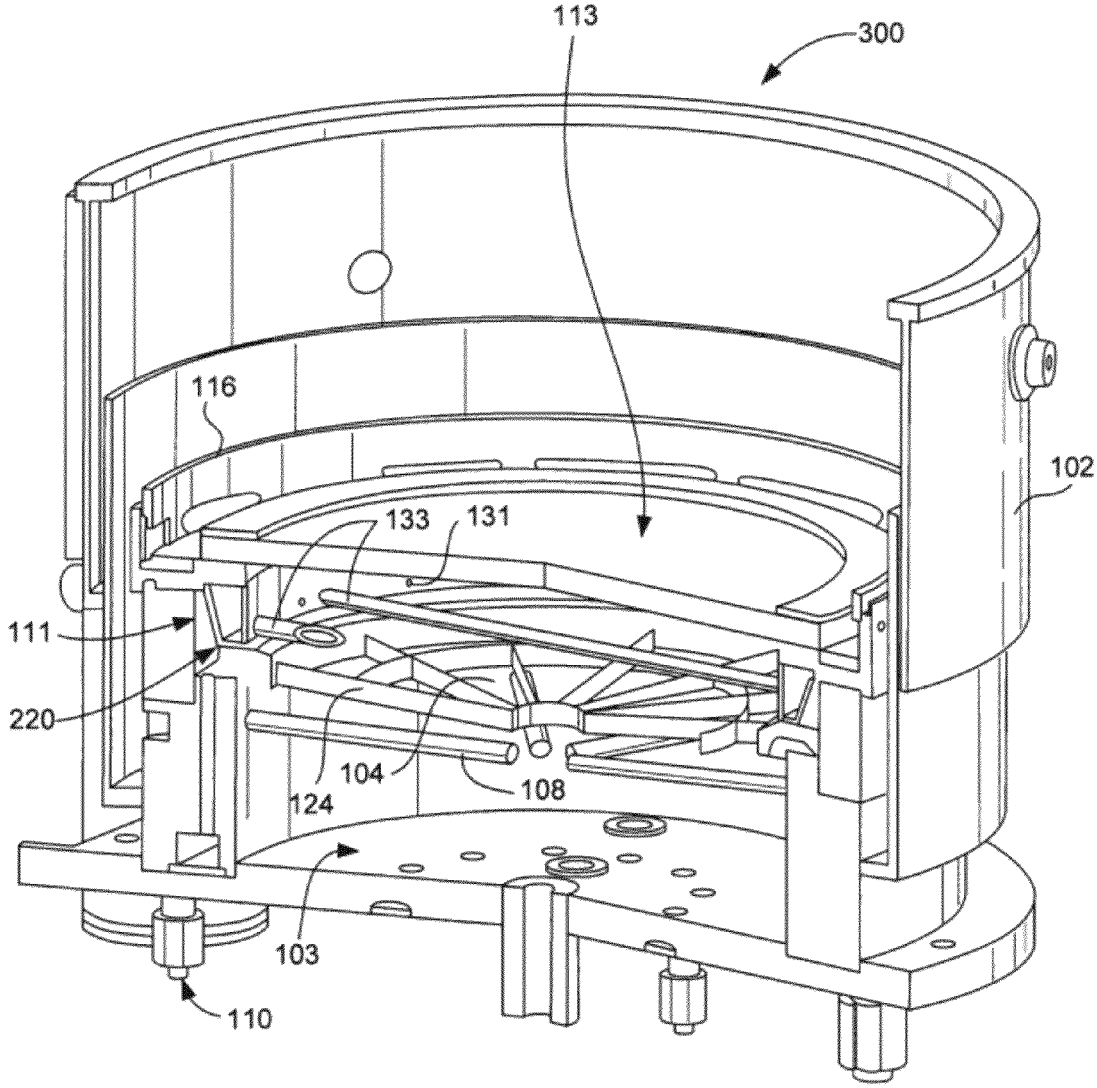
Figure 4:
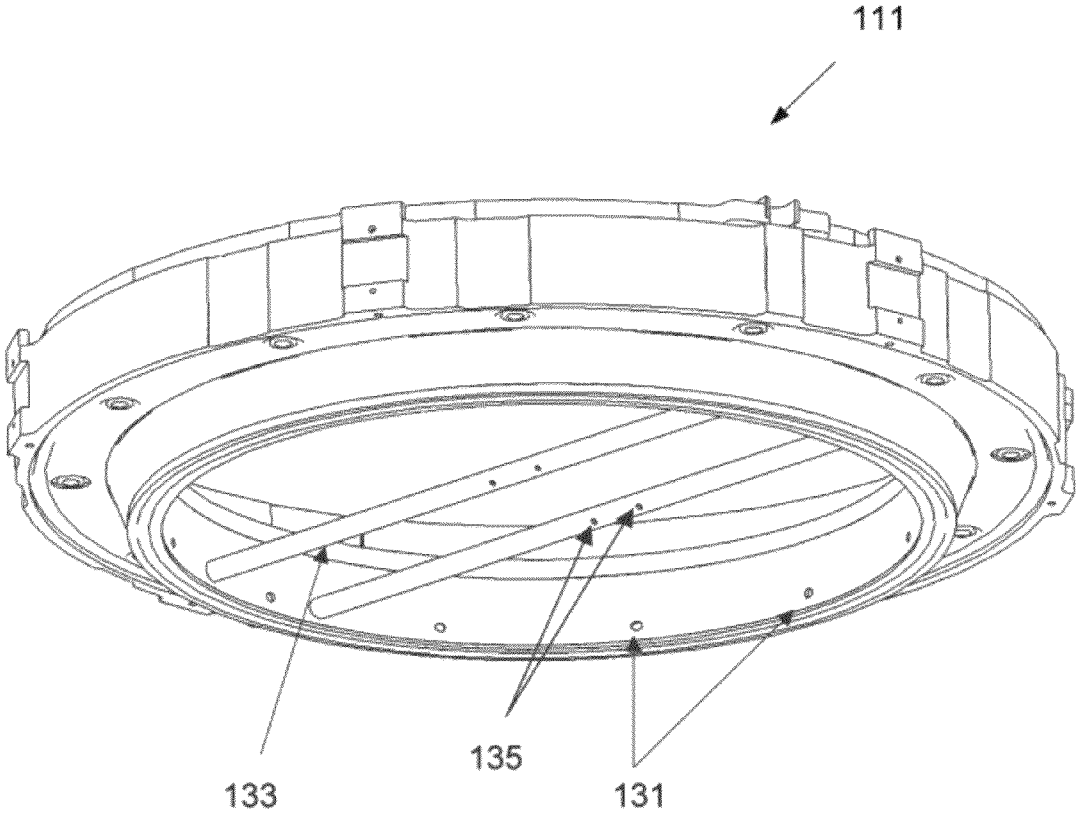
FIG. 4 depicts an isometric view of a catholyte manifold incorporating two flow distribution tubes.
Figure 5:
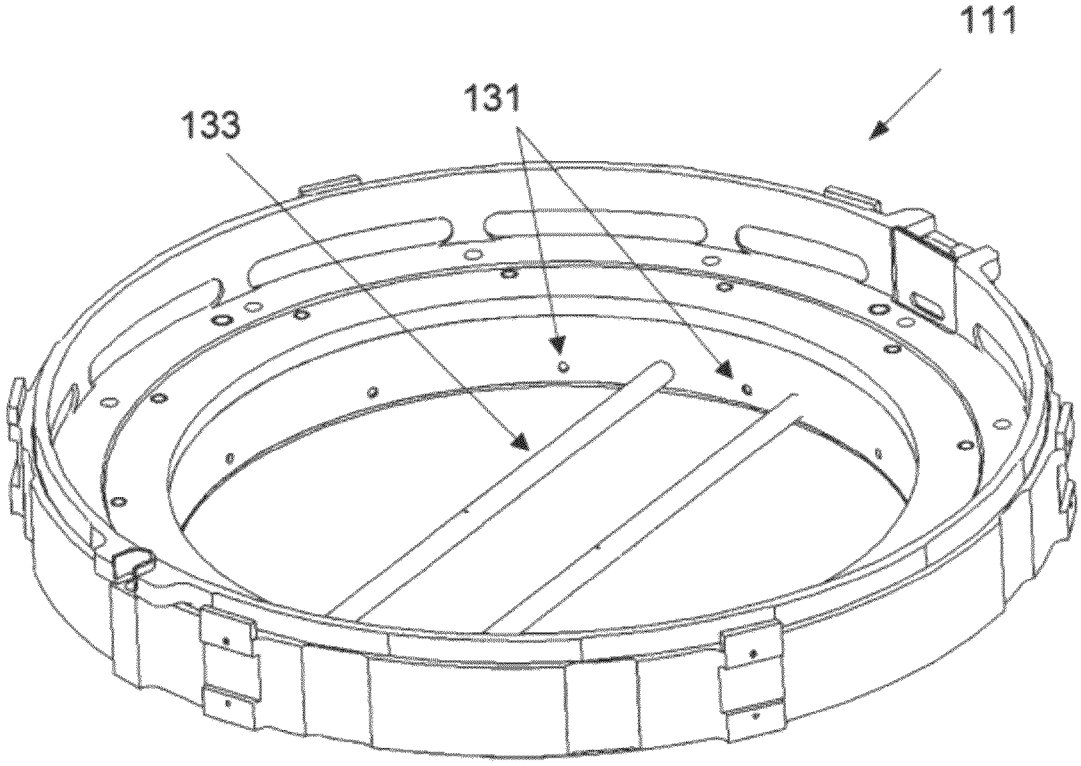
FIG. 5 depicts a different isometric view of the catholyte manifold shown in FIG. 4.

Certain embodiments are shown in FIGS. 3-5. FIG. 3A depicts an example of an electroplating cell 300 layout and components along with what might be the typical flow pattern within the apparatus. FIG. 3B is an isometric view of electroplating cell 300.

The electroplating cell 300 shown in FIG. 3A is similar to electroplating cell 100 shown in FIG. 1, but with the addition of a few components. Electroplating cell 300 includes flow distribution tubes 133 associated with the catholyte manifold 111. In some embodiments, the flow distribution tubes 133 are composed of a non-conducting material, such as a polymer or ceramic. In some embodiments, a flow distribution tube is a hollow tube with walls composed of small sintered particles. In other embodiments, a flow distribution tube is a solid walled tube with drilled holes therein. Other designs are also possible that enable good mixing in the catholyte chamber.

Various embodiments of flow distribution tubes are described herein. The flow distribution tubes may be oriented with their openings (e.g., such as holes) arranged to direct fluid flow at the membrane interface. The flow distribution tubes may also be oriented or configured to direct fluid flow to regions in the catholyte chamber other than the membrane interface. A flow distribution tube may traverse the entire chamber or terminate at some point from the chamber periphery short of the entire chamber diameter. A tube may pass though the center of the system, or cross from one side of the catholyte manifold to the other outside of the center, with the open holes directing flow to the center or elsewhere. For example, the location, the hole configuration (i.e., different hole sizes, different hole densities in different regions of the tube, and holes oriented at different positions along the circumference of the tube) and orientation of a flow distribution tube may be configured to achieve a desired flow pattern. The location and size of the flow distribution tubes 133 should be such that the average electric field and current flow-blocking characteristics of the tubes are minimized, so as to achieve the most uniform plating possible. In one embodiment, one or more small off-center tubes (typically with a diameter of about 0.125 to 0.5 inches) cross from one side of the catholyte chamber to the other, and connect to the manifold at both ends.

In further embodiments, the catholyte manifold 111 of electroplating cell 300 includes small ports or holes 131 in the catholyte manifold (see FIG. 3B). Holes 131 are configured to deliver catholyte to the catholyte chamber. In some embodiments, the holes are configured to deliver a turbulent flow of catholyte to the catholyte chamber.

In FIG. 3B, two flow distribution tubes are shown; one tube is depicted in the foreground as a cut-open cross-section, and one tube located toward the back of the figure is depicted traversing the catholyte chamber. More tubes can be used if required. Alternatively, instead of small ports or holes 131, some other external flow restriction can be introduced to the catholyte manifold. This allows for a high velocity fluid to enter into the catholyte chamber and mix the fluid therein. Also shown in FIG. 3B are membrane 104 supported by membrane frame 124. In FIG. 3B, the flow distribution tubes are substantially parallel to the plane of the membrane.

FIGS. 4 and 5 are different views of the catholyte manifold 111. These figures show flow distribution tubes 133. FIG. 4 depicts an isometric view of a ring-shaped catholyte manifold incorporating two flow distribution tubes. Each of the porous flow distribution tubes shown in FIG. 4 has two holes 135 which direct fluid flow towards the membrane interface. Also shown in FIG. 4 are holes 131 in the catholyte manifold (two are highlighted with arrows). FIG. 5 depicts a different isometric view of the catholyte manifold shown in FIG. 4.

While the flow distribution tubes are depicted as one embodiment, other structures may accomplish the same result. There may be only one flow distribution tube, or alternatively two of more flow distribution tubes. Also, the flow distribution tubes may have different number of holes in them (i.e., not only two). Other catholyte delivery systems may include: (1) flow distribution tubes without holes or porosity that have catholyte exiting from the tube end, with the orientation and size of the tube end controlling the fluid flow direction and velocity (i.e., the flow distribution tubes do not project across the catholyte chamber); (2) flow distribution tubes not oriented parallel to the plane of the membrane; (3) flow distribution tubes exiting from different positions of the catholyte manifold region, not only from a position close to the membrane; and, (4) flow distribution tubes with holes or porosity that have open tube ends. These catholyte delivery structures are a few of the many different structures that may be used as flow distribution tubes.

Furthermore, the combination of flow distribution tubes and holes in the catholyte manifold 111 may be tailored to achieve the desired fluid flow. For example, fluid flow may be turbulent from the flow distribution tubes and laminar from the holes, or vice versa. Again, the catholyte delivery structures may take many different forms and configurations.

While the HRVA plate is effective in increasing the system resistance and making the current distribution on the wafer somewhat insensitive to current blocking features below the HRVA plate, some distance between the lower portion of the HVRA plate and the flow distribution tubes may be required to allow current lines to pass around and into the HRVA pores located right above the tubes. Therefore, in some embodiments, a flow distribution tube may be located at least about one diameter, and in further embodiments, between about two to five tube diameters, distant below the closest face of the HRVA plate. While greater distances can be used, the economics of wasted space and the difficulty of imparting strong convective flow, or even turbulence, into a larger catholyte chamber may be considered. Similarly, the flow distribution tubes may be far enough away from the membrane interface to allow for current to pass easily around the tubes and not block any of the membranes surfaces There should also be sufficient spacing to allow for flow exiting the holes or pores of the tube to diffuse and impinge a significant amount of membrane surface. In some embodiments, the catholyte manifold and the tubes are located immediately above the membrane. In other embodiments, the tubes are be located at least about one diameter, and in further embodiments, between about two to four tube diameters, from the membrane interface.

Electroplating chamber 300 may also include a bubble-separation manifold chamber 220, also referred to as vented manifold chamber. When the manifold is located at the side of the cell, it is referred to as a Vented Side Manifold Chamber. A more detailed description of embodiments of a bubble separation section may be found in U.S. patent application Ser. No. 12/337,147, filed Dec. 17, 2008, which is incorporated herein by reference in relevant part. For other methods of removing bubbles from an electrolyte, see for example U.S. patent application Ser. No. 09/872,340 titled METHODS AND APPARATUS FOR BUBBLE REMOVAL IN WAFER WET PROCESSING, filed May 31, 2001, which is incorporated herein by reference in relevant part.

Figure 6:
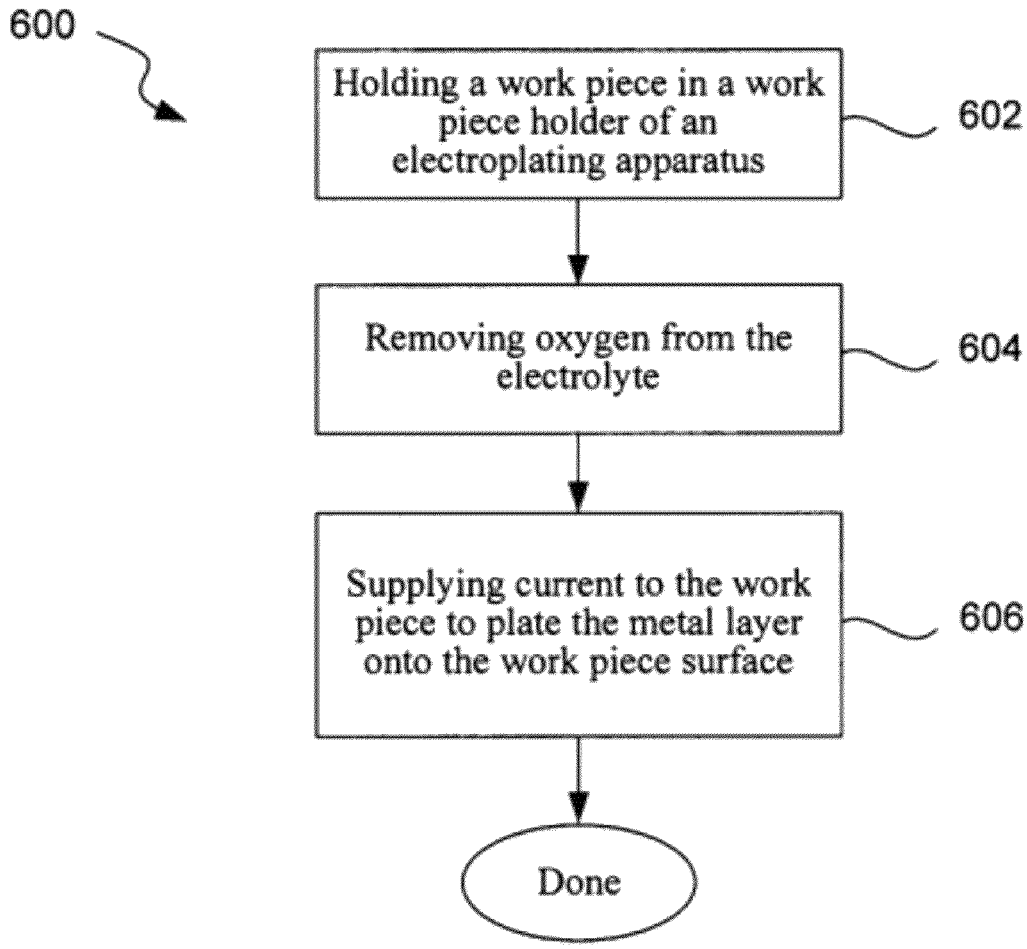
FIG. 6 depicts important stages in a general process flow for a method of electroplating a layer of metal onto a work piece surface in accordance with embodiments described herein.

FIG. 6 depicts important stages in a general process flow for a method of electroplating a layer of metal onto a work piece surface in accordance with embodiments described herein. The method 600 involves holding a work piece in a work piece holder of an electroplating apparatus (602). The apparatus includes a membrane separating the chamber into an anolyte chamber and a catholyte chamber. The catholyte chamber includes a catholyte manifold and at least one flow distribution tube associated with the catholyte manifold. The catholyte manifold and the at least one flow distribution tube are configured to increase convection of an electrolyte at the membrane. Oxygen is removed from the electrolyte (604). Current is supplied to the work piece to plate a metal layer onto the work piece (606).

Embodiments described herein reduce the need to replace the membrane due to its damage/degradation, improve the system's cost of ownership (CoO) and reliability, and reduce maintenance requirements. There is also approximately a 50% reduction or more in wafer defects.

While embodiments have been described by particular examples, these examples were presented for illustrative purposes and should not be construed as in any way limiting in the scope. It is recognized that those with skill in the art, after reviewing the principles and results laid out in detail here, could modify the detail designs, orientations, etc. described herein while not falling outside the overall scope.

To recap, in embodiments described herein, flow that enters the catholyte chamber is directed downwards by a mechanism such as a set of flow distribution tubes or other mechanism to cause mixing of fluid within the catholyte chamber. Without such mixing, the fluid is allowed to largely bypass the membrane surface and proceed directly out of the HRVA plate holes. This directed flow causes a significant reduction in plated wafer defects, increases the current and temperature operating range of the tool (avoiding potential non-uniformity excursions), and allows for very long term stable performance results.

EXPERIMENTAL RESULTS

Plated work pieces were examined to determine improvements in metal plated according to embodiments described herein. A direct comparison was performed by running two plating cells simultaneously, both fed from the same main plating bath reservoir (i.e., catholyte reservoir), but one cell with flow distribution tubes in the catholyte chamber, the other without flow distribution tubes. Each cell continuously cycled and plated 2500 wafers, each wafer plated with 0.8 μm of copper, in a continuous fashion. A number of defect grade test wafers were plated periodically throughout the test in the plating cells configured with and without the catholyte flow distribution tubes and analyzed on a KLA AIT Model XP defect analyzer (sensitive to defects greater in size than about 90 nm).

Figure 7:
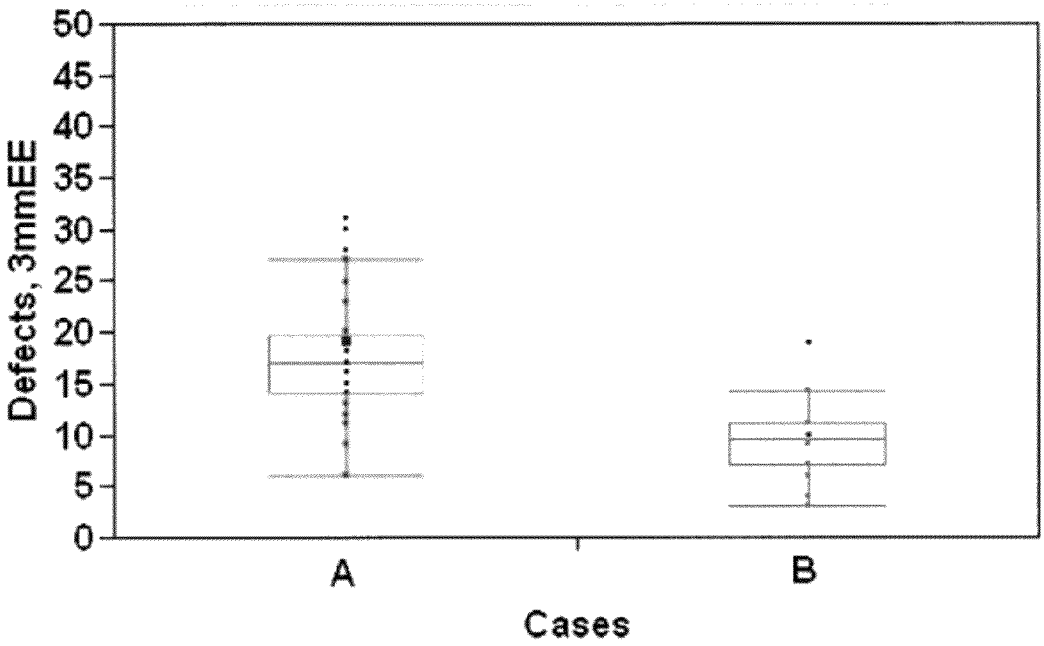
FIG. 7 is a plot showing that there is a large (approximately 46%) and statistically significant reduction in the average number of defects for wafers plated in a chamber and using the process of an embodiment.

FIG. 7 is a plot showing that there is a large (approximately 46%) and statistically significant reduction in the average number of defects for wafers plated in a chamber and using the process of an embodiment described herein. The units on the y-axis (i.e., 3 mmEE) are the total number of defects on the wafer at 3 mm edge exclusion, which means that the measurement is made on the entire surface of a wafer except the outermost 3 mm edge of the wafer. It is believed that this reduction in defects is due to the elimination of defects emanating from the membrane (either salt or metal particles that are formed there).

Figure 8:
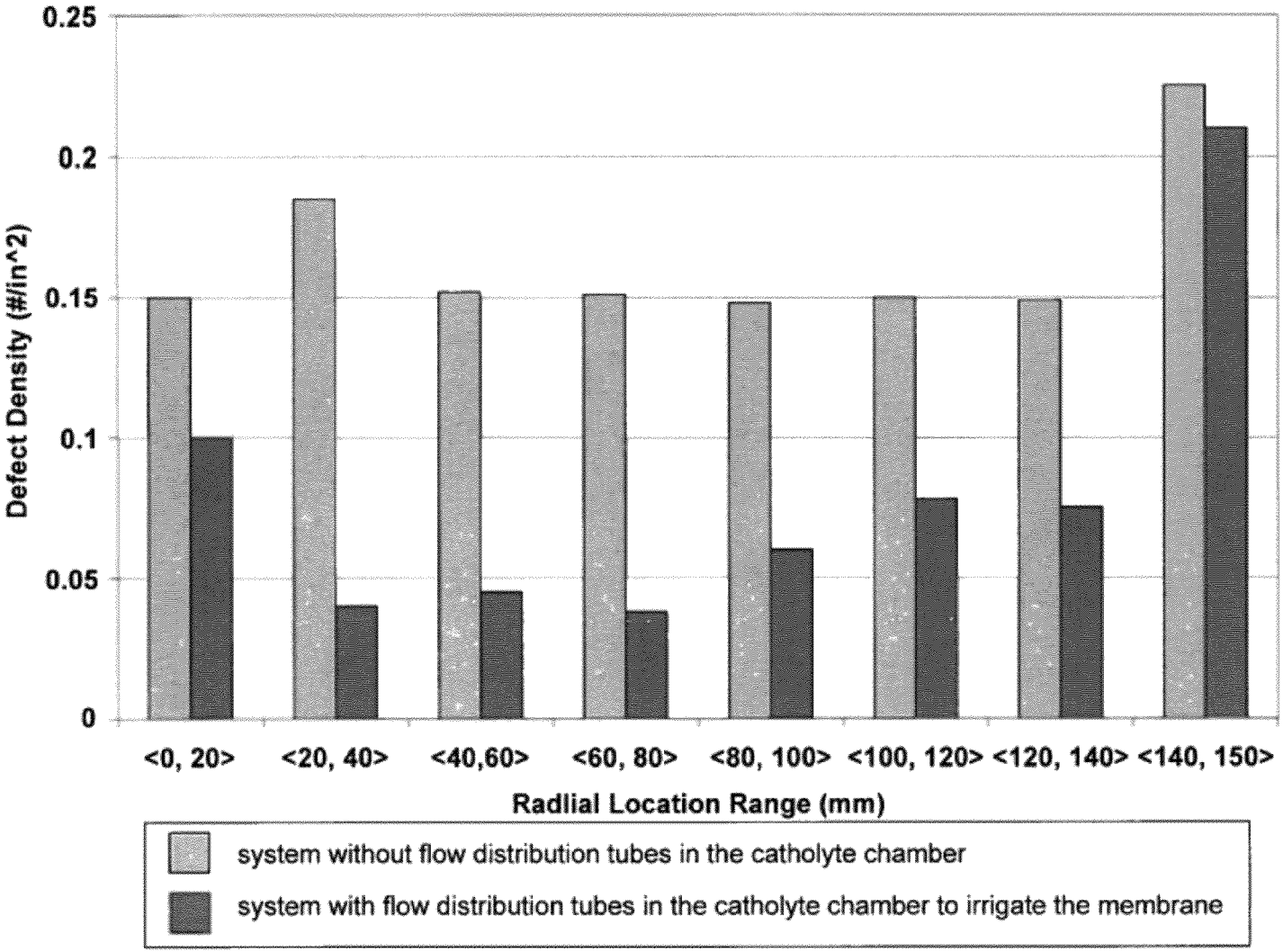
FIG. 8 is a plot showing the area specific defect density (average number of defects observed during the test in a particular radial range from the center) of a wafer plating in a chamber of an embodiment.

FIG. 8 is a plot showing the area specific defect density of a wafer (average number of defects observed during the test in a particular radial range from the center of a wafer) plated in a chamber of an embodiment described herein compared to a wafer plated in a chamber without flow distribution tubes in the catholyte chamber. FIG. 8 shows that the reduction in the defect density resulting from using an embodiment is uniform and similar at all radial regions, with the exception in the very edge region. At the very edge region, the defect density tends to be greater and dominated by mechanisms associated with the closed-clamshell wafer-holding-apparatus used in the test.

Figure 9:
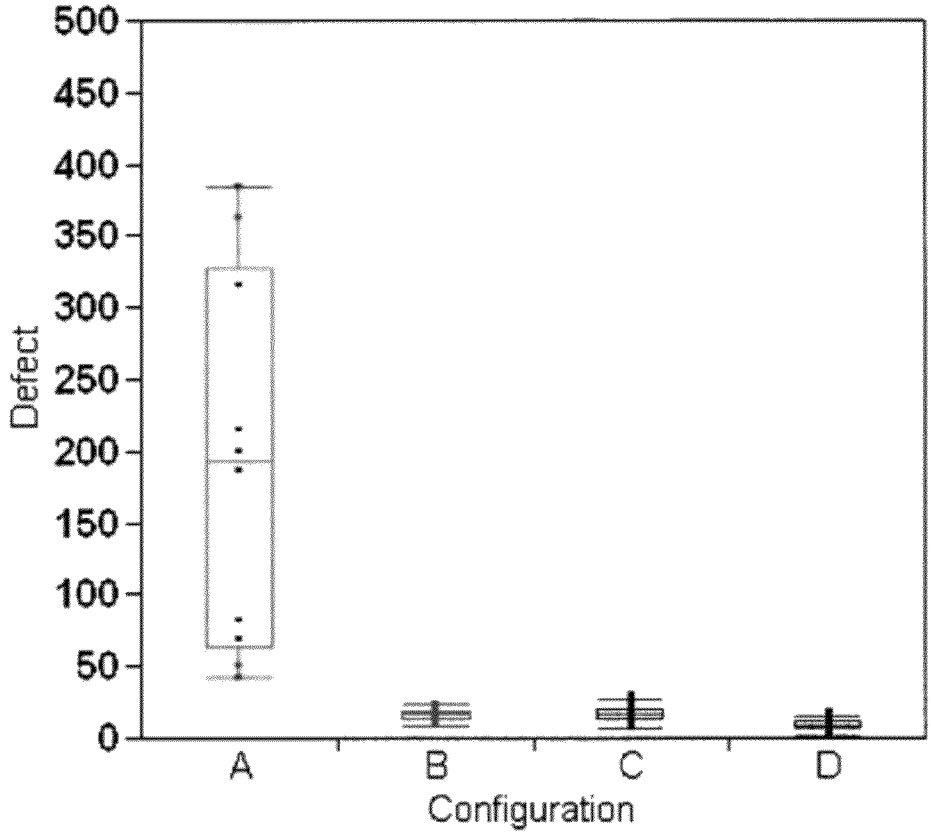
FIG. 9 is a plot showing the total number of defects for copper plated in cells with poor irrigating hardware versus good irrigating hardware, with either low $O_2$ level (oxygen removed) or high $O_2$ level (air saturated electrolyte).

FIG. 9 is a plot showing the total number of defects for copper plated in cells with poor irrigating hardware versus good irrigating hardware (e.g., a catholyte manifold with holes and associated flow distribution tubes), with either low $O_2$ level (oxygen removed) or high $O_2$ level (air saturated electrolyte). Oxygen is removed by passing the electrolyte though a degassing contactor loop with the shell side of the degasser under partial vacuum. The low oxygen concentration levels are about 0.5 to 1 ppm, and the high oxygen levels are about 8 ppm oxygen. FIG. 9 shows that a much higher level of defects is observed in the combined case of both poor catholyte chamber irrigation and low oxygen concentration. Generally, acceptable levels of defects can be obtained with or without significant oxygen. This data indicates the best situation for producing the smallest number of surface defects is the combination of both good irrigation and high oxygen level. However, this slight difference in defect performance should be balanced by the potential advantages obtained by deoxygenating the electrolyte, such as creating more of one type of defect (e.g., non-plated bubble related pits) over another (e.g., metal inclusions), and the change in feature filling behavior (low oxygen being favored because of reduced wafer metal seed corrosion).

CONCLUSION

Although the foregoing apparatus and method has been described in some detail for purposes of clarity of understanding, it will be apparent that certain changes and modifications may be practiced within the scope of the appended claims. It should be noted that there are many alternative ways of implementing both the process and compositions described herein. Accordingly, the present embodiments are to be considered as illustrative and not restrictive, and embodiments are not to be limited to the details given herein.

All references cited herein are incorporated by reference for all purposes.

What is claimed is:

1. An apparatus for electroplating a layer of metal onto a work piece surface, the apparatus comprising:

(a) a chamber;

(b) a membrane separating the chamber into an anolyte chamber and a catholyte chamber; and (c) a catholyte manifold region associated with the catholyte chamber, the catholyte manifold region comprising:

a ring-shaped catholyte manifold, and at least one flow distribution tube associated with the catholyte manifold, the at least one flow distribution tube being located wholly within the catholyte chamber.

2. The apparatus of claim 1, wherein the membrane is a cationic membrane.

3. The apparatus of claim 1, wherein the catholyte manifold region is located immediately above the membrane.

4. The apparatus of claim 1, wherein a flow distribution tube is located at least about one tube diameter from the membrane.

5. The apparatus of claim 1, wherein a flow distribution tube is located between about two to four tube diameters from the membrane.

6. The apparatus of claim 1, further comprising:

a diffuser plate at the top of the catholyte chamber, wherein a flow distribution tube is located at least about one tube diameter from the diffuser plate.

7. The apparatus of claim 1, further comprising:

a diffuser plate at the top of the catholyte chamber, wherein a flow distribution tube is located between about two to five tube diameters from the diffuser plate.

8. The apparatus of claim 1, wherein a flow distribution tube is configured to deliver a flow of an electrolyte towards the membrane.

9. The apparatus of claim 1, wherein the catholyte manifold includes holes configured to deliver a flow of an electrolyte.

10. The apparatus of claim 9, wherein the catholyte manifold is configured to deliver a turbulent flow of the electrolyte from the holes in the catholyte manifold.

11. The apparatus of claim 1, wherein a flow distribution tube comprises a porous tube.

12. The apparatus of claim 1, wherein a flow distribution tube comprises a tube with at least one hole along the circumference of the tube.

13. The apparatus of claim 12, wherein the flow distribution tube is configured to deliver a turbulent flow of an electrolyte from the at least one hole along the circumference of the tube.

14. The apparatus of claim 12, wherein the at least one hole in the tube is oriented in a direction of the membrane.

15. The apparatus of claim 1, wherein a flow distribution tube comprises a tube with at least two holes along the circumference of the tube, wherein the holes have different diameters.

16. The apparatus of claim 1, wherein a flow distribution tube includes two ends, one end attached to one area of the catholyte manifold and the other end attached to a second area of the catholyte manifold.

17. The apparatus of claim 1, wherein a flow distribution tube includes two ends, one end attached to the catholyte manifold and one end not attached to the catholyte manifold.

18. The apparatus of claim 1, wherein a plane containing a flow distribution tube is substantially parallel to a plane of the membrane.

19. The apparatus of claim 1, further comprising:

an anolyte manifold region associated with the anolyte chamber, the anolyte manifold region comprising:

an anolyte manifold, and at least one flow distribution tube associated with the anolyte manifold.

20. An apparatus for electroplating a layer of metal onto a work piece surface, the apparatus comprising:

(a) a chamber;

(b) a membrane separating the chamber into an anolyte chamber and a catholyte chamber;

(c) a catholyte manifold region associated with the catholyte chamber, the catholyte manifold region comprising:

a ring-shaped catholyte manifold, wherein the catholyte manifold includes holes configured to deliver a flow of an electrolyte, at least one flow distribution tube associated with the catholyte manifold, the at least one flow distribution tube being located wholly within the catholyte chamber; and (d) an anolyte manifold region associated with the anolyte chamber, the anolyte manifold region comprising:

an anolyte manifold, and at least one flow distribution tube associated with the anolyte manifold.

21. A method of electroplating a layer of metal onto a work piece surface, comprising:

(a) holding a work piece in a work piece holder of an electroplating apparatus, wherein the apparatus includes a membrane separating the chamber into an anolyte chamber and a catholyte chamber, wherein the catholyte chamber includes:

a ring-shaped catholyte manifold, and at least one flow distribution tube associated with the catholyte manifold and located wholly within the catholyte chamber, the catholyte manifold and the at least one flow distribution tube configured to increase convection of an electrolyte at the membrane;

(b) removing oxygen from the electrolyte; and (c) supplying current to the work piece to plate a metal layer onto a work piece surface.

* * * * *